United States Patent [19]

Latina

[11] 4,346,481

[45] Aug. 31, 1982

[54] BASEBALL MITT

[75] Inventor: Roland N. Latina, Belleville, Ill.

[73] Assignee: A-T-O Inc., Willoughby, Ohio

[21] Appl. No.: 238,364

[22] Filed: Feb. 26, 1982

[51] Int. Cl.[3] ..... A41D 13/08

[52] U.S. Cl. ..... 2/19

[58] Field of Search ..... 2/19, 158

[56] References Cited

U.S. PATENT DOCUMENTS

| | | | |
|---|---|---|---|
| 447,233 | 2/1891 | Decker | 2/19 |
| 980,679 | 1/1911 | Rogers | 2/19 |
| 2,434,170 | 1/1948 | Latina | 2/19 |
| 2,434,171 | 1/1948 | Latina | 2/19 |
| 2,681,448 | 6/1954 | Tompkins | 2/19 |
| 3,321,771 | 5/1967 | Latina | 2/19 |
| 4,192,018 | 3/1980 | Latina | 2/19 |

*Primary Examiner*—Henry Jaudon

*Attorney, Agent, or Firm*—Senniger, Powers, Leavitt and Roedel

[57] ABSTRACT

A baseball mitt comprising front and back plies forming a mitt body having thumb portion, a finger portion and a portion connecting the thumb and finger portions, and a glove secured to the back of the body with the front of the glove facing the back ply. The glove has a thumb stall disposed generally behind the thumb portion of the body, at least one finger stall disposed generally behind the finger portion of the body, a crotch portion between the thumb and finger stalls, a palm portion, and a hand-receiving opening adjacent the bottom of the mitt. The glove is joined to the mitt body at the periphery of the hand-receiving opening and at the ends of the thumb and finger stalls, but is free of attachment to the body at its palm portion, thereby providing freedom of movement of the palm portion of the glove relative to the mitt body for increasing the flexibility of the mitt.

10 Claims, 4 Drawing Figures

BASEBALL MITT

BACKGROUND OF THE INVENTION

This invention relates to a baseball mitt, and more particularly to a baseball mitt, such as a catcher's mitt, of two-part construction for improved flexibility.

Catcher's mitts of conventional design are heavily padded in their pocket portions to provide protection for the player's hand. This padding, however, stiffens the mitt and makes it more difficult to flex or fold the mitt to a closed position to catch a ball. This is particularly true in the case of a new mitt before being broken in. Reference may be made to U.S. Pat. Nos. 980,679, 2,434,170 and 2,434,171 for baseball equipment generally in the field of this invention.

SUMMARY OF THE INVENTION

Among the several objects of the invention may be noted the provision of an improved baseball mitt having increased flexibility and improved ball-retention and energy-absorption properties; the provision of such a mitt which has a natural tendency to flex or fold to a closed position as it receives a ball to retain the ball in the mitt; the provision of an improved baseball mitt into which extra padding may readily be inserted for providing additional protection to a player's hand; the provision of such a mitt having a ball-receiving pocket a substantial portion of which is not located directly forward of the player's hand thereby to reduce the amount of impact energy transferred directly to the hand when a ball is caught in the pocket; the provision of such a mitt which is compact and pleasing in appearance; and the provision of such a mitt which is economical to manufacture.

Generally, a baseball mitt of this invention comprises front and back plies forming a mitt body having a thumb portion, a finger portion, and a portion connecting the thumb and finger portions, and glove means secured to the back of the body with the front of the glove means facing said back ply. The glove means has a thumb stall disposed generally behind the thumb portion of the body, at least one finger stall disposed generally behind the finger portion of the body, a crotch portion between said thumb and finger stalls, a palm portion, and a hand-receiving opening adjacent the bottom of the mitt. The glove means is joined to the mitt body adjacent the hand-receiving opening and at the ends of said thumb and finger stalls, but is free of attachment to the mitt body at its palm portion, thereby providing freedom of movement of the palm portion of the glove means relative to the mitt body for increasing the flexibility of the mitt.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
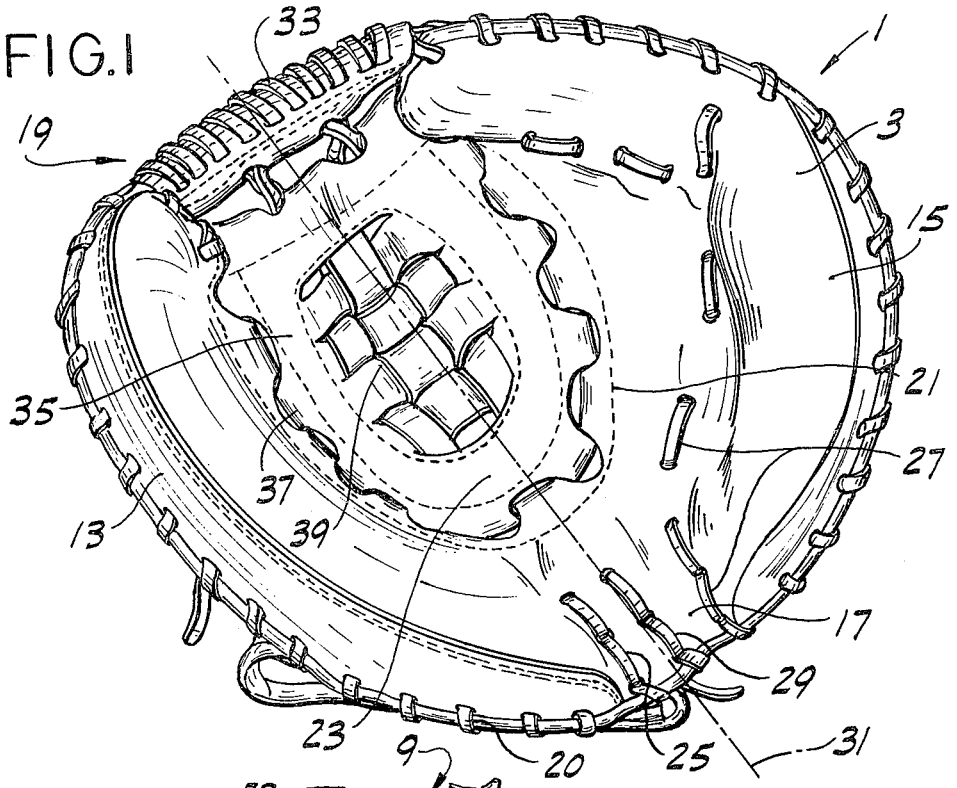
FIG. 1 is a front elevation of a catcher's mitt of this invention.

Referring now to the drawings, a mitt (e.g., a catcher's mitt, as illustrated) made in accordance with the present invention is designated in its entirety by the numeral 1. It comprises front and back plies 3, 5 of suitable sheet material, such as leather, with padding 7 interposed therebetween to form a generally circular mitt body 9. A separate hand cover or glove, generally designated 11, is stitched to the back of the mitt body. As described more fully below, this glove is attached in such a way that it is able to move relative to the mitt body 9 for increasing the overall flexibility of the mitt 1.

The mitt body 9 has a thumb portion 13 generally toward one side of the mitt (the left side as shown in FIG. 1), a finger portion 15 generally toward the other (right) side of the mitt, a portion 17 connecting the thumb and finger portions at the bottom of the mitt, and a web generally indicated at 19 secured to the inner edge margins of the thumb, finger and connecting portions. The inner and outer plies 3, 5 are joined at their outer edges, which are preferably bound, by lacing 20 extending through holes at intervals spaced around the periphery of the mitt, and at the inner edges of the thumb, finger and connecting portions 13, 15, 17 by a line of stitching 21.

The mitt padding 7 comprises two relatively thick, elongate pads of suitable cushioning material, such as felt, in the thumb and finger portions 13, 15 at opposite sides of the mitt body 9. These pads are concave inwardly toward the center of the mitt and define, at least in part, a relatively large, deep ball-receiving pocket 23 therebetween. Lacing 25 threaded through holes in the mitt body at the lower end of the thumb portion holds the thumb pad in position. Similarly, lacing 27 holds the finger pad in place. Padding 7 also includes a relatively thin pad (not shown) at the connecting portion 17. Lacing 29 laced through holes in mitt portion 17 hold this pad in position and defines in part a line 31 extending from the top of the web 19 down through the connecting portion 17 about which the mitt 1 tends to flex or fold to a closed position as a ball is caught in the mitt.

The web 19 forms the central and deepest part of pocket 23 and is intended to receive and retain the greatest number of balls caught. Accordingly, it is constructed to provide a relatively high level of energy absorption and ball retention. More specifically, the web comprises an upper strap 33 spanning the thumb and finger portions 13, 15 at the upper ends thereof, and a lower web member 35 secured to the upper strap member and to the thumb, finger and connecting portions 13, 15, 17, preferably by an interdigitated tunnel arrangement indicated at 37. This tunnel construction, which is described in detail in my U.S. Pat. No. 4,192,018, provides a smooth transition between the web and surrounding portions of the mitt body, as well as improved web and mitt flexibility. The central portion 39 of web member 35 is preferably of basket weave construction, such as shown in my U.S. Pat. No. 3,321,771.

Figure 3:
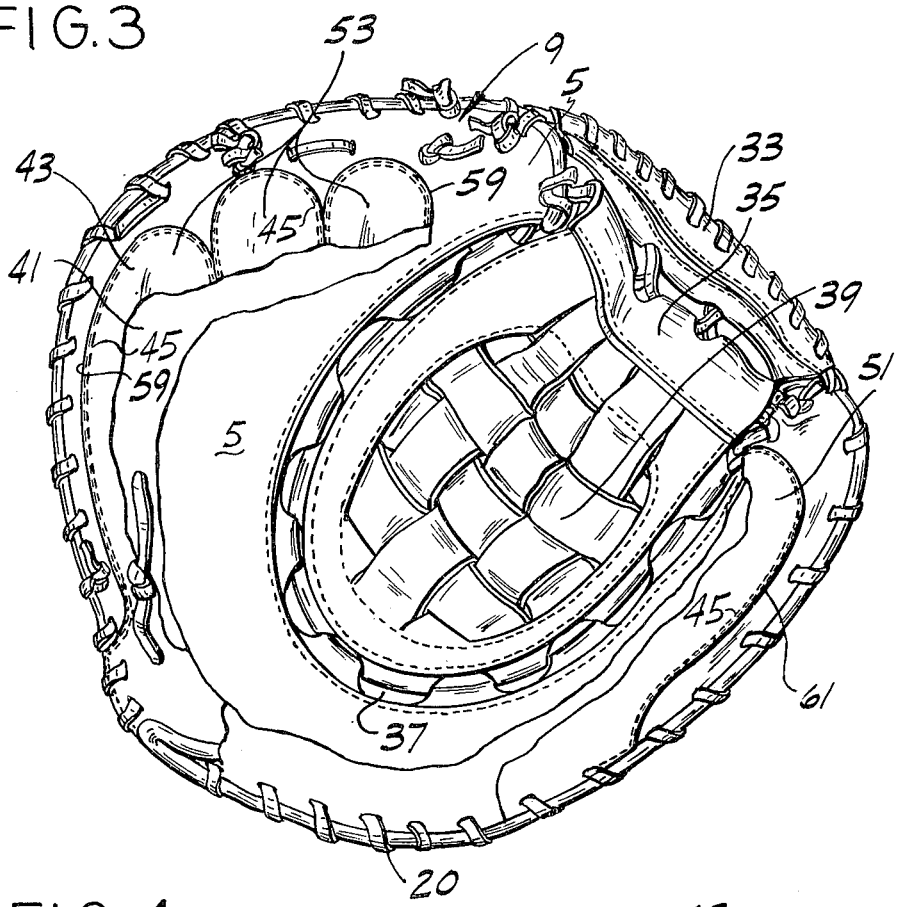
FIG. 3 is a view similar to FIG. 2 with portions of the glove removed to show the means by which it is attached to the mitt body.

The glove 11 (constituting glove means) at the back of the mitt body is of two-ply construction, comprising front and back plies 41, 43 of leather or other suitable material joined by lines of stitching indicated at 45. The glove has a palm portion 49, a relatively large thumb stall 51, a plurality of smaller finger stalls 53 (e.g., three finger stalls, as illustrated), a crotch portion 55 between the thumb and finger stalls, a hand-receiving opening or mouth 56 at the bottom of the mitt, and an adjustable wrist strap 57. This strap 57 may be of the type described in my U.S. Pat. No. 2,434,171. As best illustrated in FIG. 3, the plies 41, 43 of the glove are joined at the sides of the glove and at end and side margins of the thumb and finger stalls 51, 53 by stitching 45. The glove, in turn, is joined at its mouth 56 to the bottom of the mitt body 9 by lacing 20, at its left side and at the ends of its finger stalls 53 to the finger portion of the mitt body by stitching 59, and at its right side and at the end of its thumb stall 51 to the thumb portion of the mitt body by a line of stitching 61.

Figure 4:
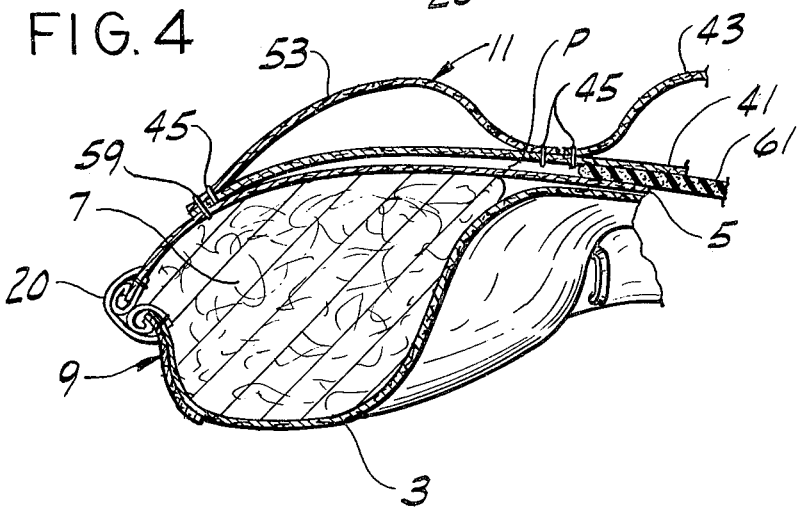
FIG. 4 is an enlarged horizontal section on line 4—4 of FIG. 2 showing an interior pocket in the mitt and padding in the pocket.

In accordance with this invention, the glove is free of attachment to the mitt body at its palm portion 49, thereby enabling the palm portion to move relative to the mitt body and defining an interior pocket P between the front ply 41 of the glove and the mitt body. The glove is also unattached to the mitt body at its crotch portion 55 for providing an opening 60 through which a selected amount of padding 61 (e.g., a pad of sponge material or foamed synthetic resin) may be inserted, if desired, for added cushion, and for providing freedom of movement between the glove and the mitt body at its crotch portion. A portion of the pocket P and of the padding 61 inserted therein are shown in FIG. 4. It will be understood that pocket P, even when empty, will provide some measure of protection by creating a "dead air" cushion between the palm portion 49 of the glove and the connecting portion 17 and web 19 of the mitt body. The thumb and finger stalls 51, 53 of the glove are also free of attachment to the mitt body except at their ends and at the sides of the glove.

Figure 2:
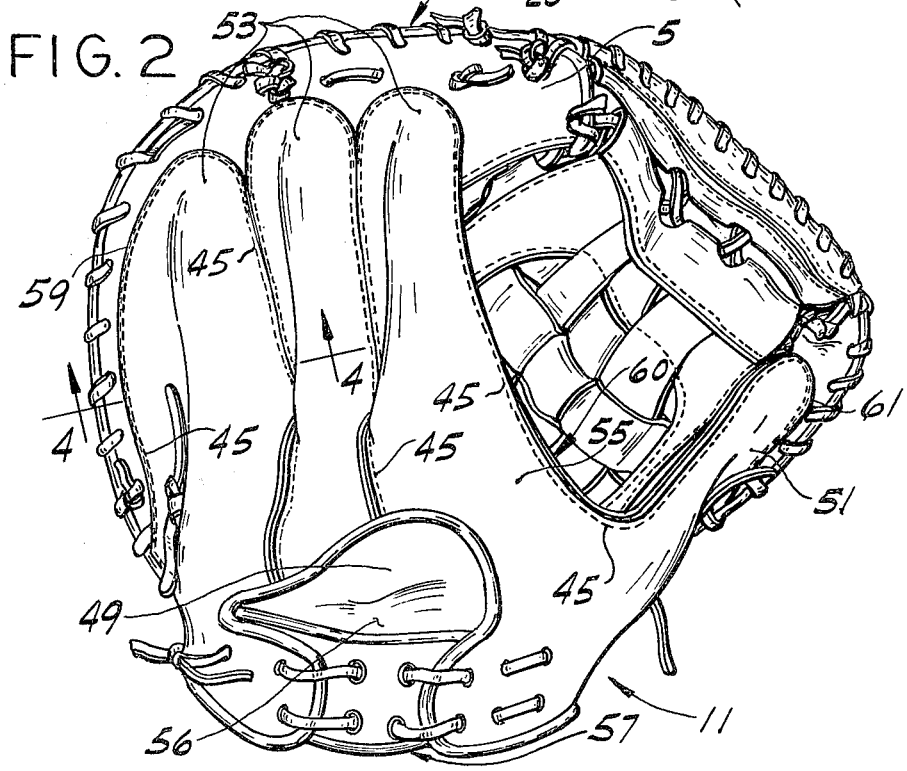
FIG. 2 is a rear elevation of the mitt showing a glove joined to the mitt body.

As illustrated in FIG. 2, the glove 11 is so positioned with respect to the mitt body that only a minimal portion of a player's hand, when received in the glove, is located directly behind the web 19 of the mitt which is intended to receive most balls. It will be observed in this regard that the crotch 55 of the glove is disposed behind only the lower portion of the web 19, leaving the upper portion of the web free to receive balls with only a minimum impact effect on the hand. Moreover, with the glove so positioned on the mitt body, the line 31 about which the mitt flexes or folds is generally coincident with the line (not shown) about which the player's hand tends to flex so that upon impact of a ball at or near the line of flexure 31 there is a natural tendency of the hand and the mitt to flex about the line 31 to a closed position. The freedom of movement between the glove 11 and mitt body 9 facilitates this flexing movement.

It will be observed from the foregoing that mitt 1 provides adequate protection and greater flexibility even when new. Given the fact that the mitt is especially flexible about line 31 and thus may readily be snapped shut, it is particularly suited for "one-handed" catching, which requires a relatively high level of mitt control and ball retention.

While mitt 1 has been shown and described as a catcher's mitt, it is contemplated that the principles of this invention may be incorporated into other baseball mitts or gloves such as a first baseman's mitt or a fielder's glove.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A baseball mitt comprising front and back plies forming a mitt body having a thumb portion, a finger portion and a portion connecting the thumb and finger portions, and glove means secured to the back of the body with the front of the glove means facing said back ply, said glove means having a thumb stall disposed generally behind the thumb portion of the mitt body, at least one finger stall disposed generally behind the finger portion of the body, a crotch portion between said thumb and finger stalls, a palm portion, and a hand-receiving opening adjacent the bottom of the mitt, said glove means being joined to the body of the mitt adjacent said hand-receiving opening and at the ends of said thumb and finger stalls, but being free of attachment to the mitt body at its said palm and crotch portions, thereby forming a pocket in the mitt between the front of the glove means and the back of the body having an opening through which padding or the like may be inserted into the pocket, and providing freedom of movement of the palm and crotch portions of the glove means relative to the body of the mitt for increasing the flexibility of the mitt.

2. A baseball mitt as set forth in claim 1 wherein said glove means is also joined to the body of the mitt at the sides of the glove means.

3. A baseball mitt as set forth in claim 2 wherein said pocket is open only at said crotch portion of the glove means.

4. A baseball mitt as set forth in claim 1 wherein the glove means comprises front and back plies joined together at seams to form a glove.

5. A baseball mitt as set forth in claim 4 wherein said glove comprises a plurality of finger stalls, the front and back plies of the glove being joined at the sides of the glove and at edge margins of the thumb and finger stalls.

6. A baseball mitt as set forth in claim 5 wherein said thumb and finger stalls of the glove are free of attachment to said mitt body except at the ends thereof and at the sides of the glove.

7. A baseball mitt as set forth in claim 1 wherein said mitt body has a web between its finger and thumb portions, the crotch portion of the glove means being disposed behind a lower portion of the web.

8. A baseball mitt as set forth in claim 7 wherein the mitt body is adapted to flex about a line extending from adjacent the top of the web down to said connecting portion of the mitt body.

9. A baseball mitt as set forth in claim 7 wherein said web has a central portion of basket-weave construction.

10. A baseball mitt as set forth in claim 7 wherein the web is secured to the inner margins of the thumb and finger portions of the mitt body by an interdigitated tunnel arrangement in which lacing extends through the tunnels.

* * * * *

UNITED STATES PATENT AND TRADEMARK OFFICE

CERTIFICATE OF CORRECTION

PATENT NO. : 4,346,481

DATED : August 31, 1982

INVENTOR(S) : Roland N. Latina

It is certified that error appears in the above—identified patent and that said Letters Patent is hereby corrected as shown below:

Front page, item "[22]", "Feb. 26, 1982" should read -- Feb. 26, 1981 --.

Signed and Sealed this

Eighth Day of March 1983

[SEAL]

*Attest:*

GERALD J. MOSSINGHOFF

*Attesting Officer*

*Commissioner of Patents and Trademarks*